United States Patent [19]

Holum et al.

[11] Patent Number: 5,069,044

[45] Date of Patent: Dec. 3, 1991

[54] ICE BLOCK PRESS

[75] Inventors: Ronald L. Holum, New Brighton; Patrick M. Brown, Anoka; Ronald L. DeWall, Loretto, all of Minn.

[73] Assignee: PRR Industries, Inc., Monticello, Minn.

[21] Appl. No.: 482,531

[22] Filed: Feb. 21, 1990

[51] Int. Cl.[5] ..... F25C 5/14

[52] U.S. Cl. ..... 62/320; 62/341; 100/48; 100/95; 100/215; 100/218

[58] Field of Search ..... 62/320, 341; 100/48, 100/52, 95, 97, 215, 218, 253, 256

[56] References Cited

U.S. PATENT DOCUMENTS

| | | | |
|---|---|---|---|
| 3,082,588 | 3/1963 | Jay et al. | 100/95 X |
| 3,643,873 | 2/1972 | George | 100/95 X |
| 3,708,078 | 1/1973 | Clements | 100/52 X |
| 3,908,538 | 9/1975 | Boyd | 100/52 X |
| 3,921,545 | 11/1975 | Ruegsegger | 100/95 X |
| 4,007,677 | 2/1977 | Fox | 100/218 X |
| 4,343,233 | 8/1982 | Burgin | 100/48 X |
| 4,421,022 | 12/1983 | Burgin | 100/218 X |
| 4,780,119 | 10/1988 | Brooke | 62/341 X |

*Primary Examiner*—William E. Tapolcai
*Attorney, Agent, or Firm*—Lawrence M. Nawrocki

[57] ABSTRACT

An ice block press device (10). The press (10) includes a compression chamber (12) into which raw ice particles (20) are fed through an opening (82). A ram (16) is employed to urge ice particles (20) deposited through an input chute (18), through the opening (82) into the compression chamber (12). The ram (16) cyclically reciprocates to push the particles (20) into the chamber (12). As additional amounts of raw ice are urged into the chamber (12), a compacted volume of accumulated ice begins to extend through the opening (82) outside the chamber (12). When this occurs, the ram (16) is precluded from achieving its fully extended position. Upon sensing this condition, a knife (80) is driven to cut the block to a uniform length.

16 Claims, 3 Drawing Sheets

ICE BLOCK PRESS

TECHNICAL FIELD

The present invention deals broadly with apparatus for forming ice blocks. More narrowly, however, the invention is directed to a device for uniformly forming ice blocks from ice chips and "snow" which are compacted and cut to a desired sized.

BACKGROUND OF THE INVENTION

There has been a need for block ice since time immemorial. The applications to which ice blocks can be put are many and varied. For example, prior to the introduction of electricity into residential dwellings, they were received in "ice box" devices to effect a reduction of temperature therein in order to perserve various food items.

Even with the advent of the introduction of electricity, however, the demand has not diminished. Rather, an increase in demand appears to be the trend. Numerous applications for block ice still remain, and additional applications continue to be developed.

In order to attempt to satisfy the demand for block ice, various equipments have been developed. These range from very rudimentary structures such as oversized trays in which water to be frozen is received, to sophisticated machines which strive to accomplish uniformity of product. Two characteristics—uniformity of size and uniformity of compactness—are particularly desirable to comsumers. A purchaser desires to obtain what he paid for, and an offered block of ice which is reduced in size or which has a high level of porosity is deemed to be an inferior product.

From the standpoint of the manufacturer, it is desirable that a machine for making block ice is reliable, easy to operate, and efficient. Time is money, and any reduced capacity occasioned because of machine downtime or inefficient operation is unacceptable.

It is to these problems and dictates of the prior art that the present invention is directed. It is an improved ice block press which is durable, efficient, and easy to operate, and which serves to enable the owner of the machine and/or manufacturer of block ice to give his consumer what he paid for.

SUMMARY OF THE INVENTION

The present invention is a device for forming ice blocks of a desired size and degree of compaction. The apparatus enables blocks to be formed substantially uniformly through a continuous manufacturing process. The device includes a wall which defines a compression chamber. The compression chamber functions to receive raw ice particles therein. The particles are fed into the chamber through an opening in the chamber wall by means of a ram which is disposed reciprocally to urge the ice particles through the opening and into the compression chamber, to compact the particles within the chamber, and to then retract. The invention incorporates means for sensing when movement of the ram in a direction urging the ice particles into the chamber is precluded because of an accumulation of compacted ice in the chamber. Means, responsive to the sensing of the preclusion of movement of the ram in a direction in which it moves in urging the ice particles into the chamber, for cutting the compacted ice block to a desired size are provided.

In a preferred embodiment of the invention, the cutting means comprises a knife which is disposed for reciprocal movement across the opening through which ice particles are urged. As the knife moves to an extended position to cut the block to size, it also serves to close and occlude the opening to the compression chamber in order to totally enclose the ice particles compacted therewithin.

In the preferred embodiment also, the ram is enclosed within a housing having a wall extending longitudinally in the directions in which the ram reciprocates. The ram can have, at its forward end, a piston face which actually engages the ice particles deposited between the piston face and the opening to the compression chamber to urge the particles, as the ram is moved forwardly toward the opening to the compression chamber, through the opening and into the chamber. In such an embodiment, the ram can be provided with a skirt which overlies the ram to preclude the deposit of ice particles behind the ram piston face, when the piston face has been urged to an extended position wherein the ice particles have been pushed into the chamber.

Sensing of a situation wherein movement of the ram piston face to a position it occupies when the ram is fully extended is precluded because of an accumulation and compaction of ice particles within the chamber can be accomplished by providing the skirt with a plurality of recesses. A first recess can be provided within the skirt proximate the forward, piston face end of the ram, and a second recess proximate the rearward end of the skirt. A pair of limit switches can be mounted in the ram housing wall which extends longitudinally along the axis of movement of the ram. Typically, these switches would be mounted in the wall proximate the forward end thereof with a first of the two switches having a detent receivable within the first recess in the skirt when the ram piston face is in its retracted position. The second recess in the skirt is disposed relative to the second of the two switches so that, when the ram piston face is in its extended position, a detent of the second limit switch would be received within the second recess.

The present invention is, thus, an improved mechanism for forming blocks of ice. More specific features and advantages obtained in view of those features will become apparent with reference to the DETAILED DESCRIPTION OF THE INVENTION, appended claims, and accompanying drawing figures.

DETAILED DESCRIPTION OF THE INVENTION

Figure 1:
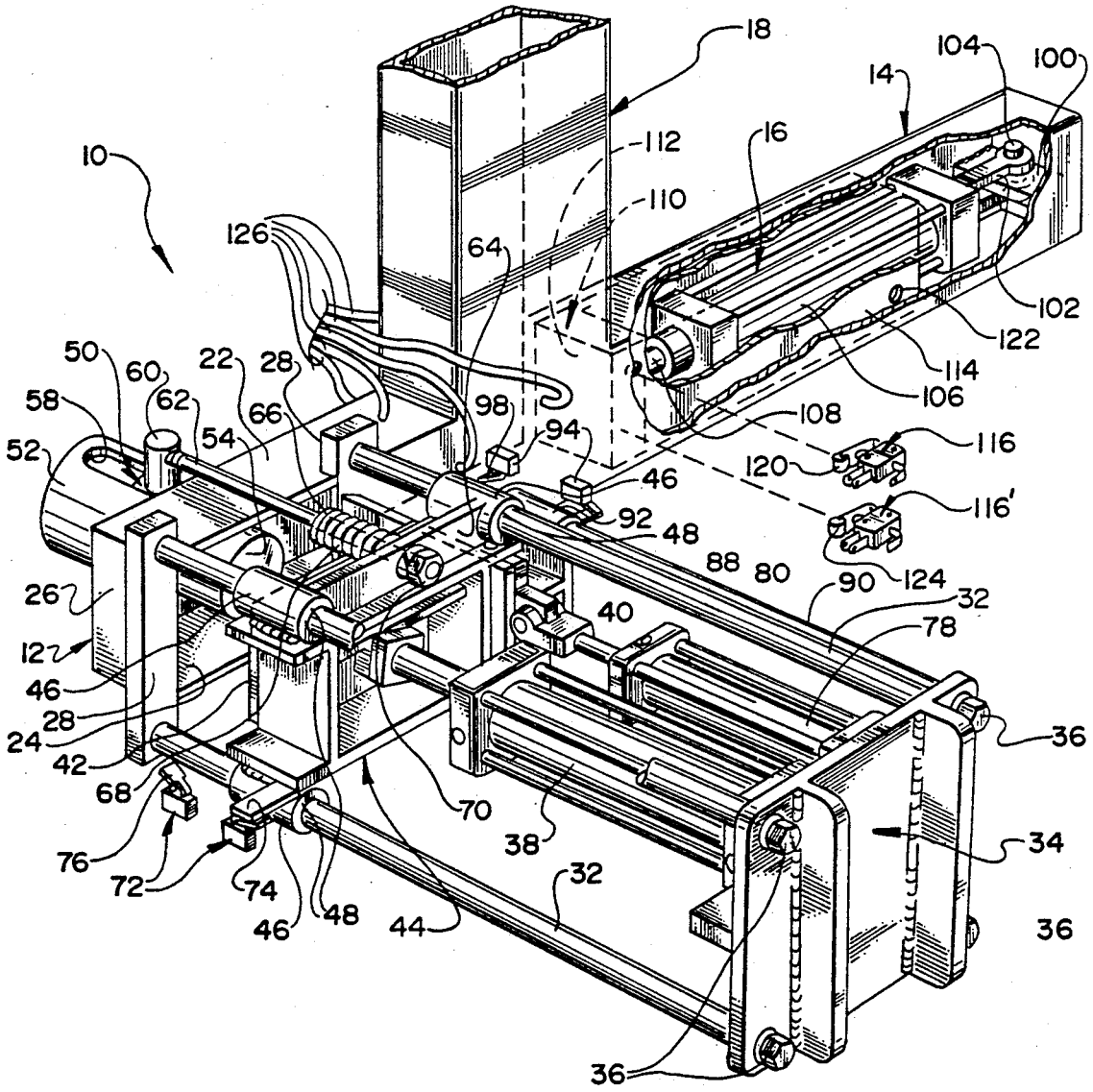
FIG. 1 is a perspective view of a press in accordance with the present invention with some parts cut away.

FIG. 1 structurally illustrates an ice block press 10 in accordance with the present invention. That figure shows a compression chamber 12 aligned along an axis with a housing 14 receiving a compression ram 16 therewithin. The bottom end of an input chute 18 for depositing ice particles 20 is interposed between the compression chamber 12 and the ram housing 14. An assembly formed of the compression chamber 12, input chute 18, and ram housing 14 is oriented and held in position by an appropriate base or suspension support (not shown). Typically, the axis along which the ram housing 14 and compression chamber 12 are aligned would be disposed horizontally.

The compression chamber 12 is defined by an upper wall 22, a lower wall 24, and a side wall 26 which extends around three of four sides of the chamber 12. The side of the chamber 12 facing the ram housing 14 is normally open in order to admit the introduction of ice particles and "snow" into the compression chamber 12.

FIG. 1 shows an assembly mounted to a side of the compression chamber 12 and extending laterally with respect to a direction in which the ice particles are introduced into the chamber 12. A pair of uprights 28 are shown as being welded to the chamber 12 so as to not occlude the side of the chamber 12. Rather, the uprights 28 are secured so as to afford egress to a block of ice 30 having been formed within the chamber 12 in a manner as will be discussed hereinafter.

A plurality of guide bars 32 are shown, one extending from each end of one of the uprights 28 generally perpendicular to the respective upright 28 from which it extends. Opposite ends of the guide bars 32 are secured to a bulkhead 34 by appropriate means such as bolts 36.

The bulkhead 34, in turn, mounts, generally centrally within a quadrilateral formed by the guide bars 32, a cylinder 38 having a compression shaft 40 mounting, at its distal end, a compression piston 42. The piston 42 is carried by a carriage 44 which is disposed within the quadrilateral and provided with guides 46 which ride on corresponding guide bars 32. As seen in FIG. 1, the guide bars 32 are circular in cross-section and are received within correspondingly shaped and sized apertures 48 in the guides 46 welded to the carriage 44. It will be understood, however, in view of this disclosure, that other than circular shapes can be employed.

The length of the compression cylinder 38 and the length of its corresponding extension shaft 40 are such as to dispose the compression piston 42, when the shaft 40 is retracted within the cylinder 38, at a sufficient distance away from the compression chamber 12 so that, after a block 30 has been formed within the chamber 12, egress will be provided along the side of the chamber 12 facing the compression piston 42. When the shaft 40 is extended from the compression cylinder 38, however, the compression piston 42 will function to close the side of the compression chamber 12 which can provide egress to the block 30. The compression piston 42 is, of course, shaped and sized to correspond to the aperture through which the ice block egresses.

The side of the compression chamber 12 opposite that closed by the compression piston 42 is provided with an ejector 50. The ejector 50 is shown as being cylindrical and received within a corresponding cylindrical housing 52 extending laterally from the compression chamber 12. The face of the ejector 50 is sized very closely proximate the shape of an aperture in the wall through which it enters the compression chamber 12. Consequently, the face of the ejector 50, as is true in the case of the compression piston 42, serves as a portion of the compression chamber wall 26.

Normally, the ejector 50 is disposed in a retracted position. When it is in this retracted position, the face 54 serves to close the opening 56 in the side wall 26 of the compression chamber 12 through which the ejector 50 enters into the chamber 12. This closure is accomplished without any obstruction or intrusion within the space within the chamber 12. As seen in FIG. 1, the ejector 50 can be extended into the chamber 12, and this is accomplished in order to push a formed block of ice 30 out of the chamber 12 after the block of ice 30 has been completely made.

As also seen in FIG. 1, the ejector housing 52 is provided with a guide slot 58 which extends longitudinally in the ejector housing 52. The slot 58 receives an extension 60 of the ejector 50 which protrudes upwardly through the slot 58. Movement of the extension 60 along the slot 58 effects movement of the ejector 50 between its retracted position, wherein the face 54 of the ejector 50 forms part of the compression chamber wall 26, and extended position wherein the ejector 50 has moved to urge the block 30 out of the chamber 12.

The figures also illustrate a tie rod 62 which extends from the ejector extension 60 to a strut 64 of the piston carriage 44 which is shown as extending between an upper pair of piston guides 46 carried by the carriage 44. The tie rod 62 is provided with an annular shoulder 66 intermediate its ends, and a coil spring 68 is received over the tie rod 62 between this annular shoulder 66 and the piston carriage strut 64.

An end of the tie rod 62 remote from the ejector extension 60 extends through an aperture in the carriage strut 64. A nut 70 can be secured onto threading at the end of the tie rod 62 to mate the carriage 44 and ejector 50 together. As will be able to be seen then, the ejector 50 is slaved to the piston carriage 44 and the piston 42 carried thereby.

Normally, the face 54 of the ejector 50 and the compression piston 42 are maintained at a defined distance from one another. This distance is substantially the width of the compression chamber 12 so that, when the face 54 of the ejector 50 closes the aperture 56 through which it extends, the compression piston 42 will close the opposite side of the chamber 12. When the ejector 50 is in this position, the ejector extension 60 is at the rearward-most end of the slot 58 in which it rides. Consequently, the ejector 50 is not able to be retracted beyond a position wherein the ejector face 54 closes the aperture 56 through which it extends.

Because of the coil spring 68 placed over the tie rod 62, however, the compression piston 42 will be able to be moved toward, and into, the compression chamber 12 a short distance even after further movement of the ejector 50 becomes precluded. This is so, since the spring 68 will permit the piston carriage 44 to move toward the ejector 50 as the spring 68 is compressed between the carriage strut 64 and the annular shoulder 66 carried by the tie rod 62. The reason for this arrangement will be discussed further hereinafter.

Figure 2:
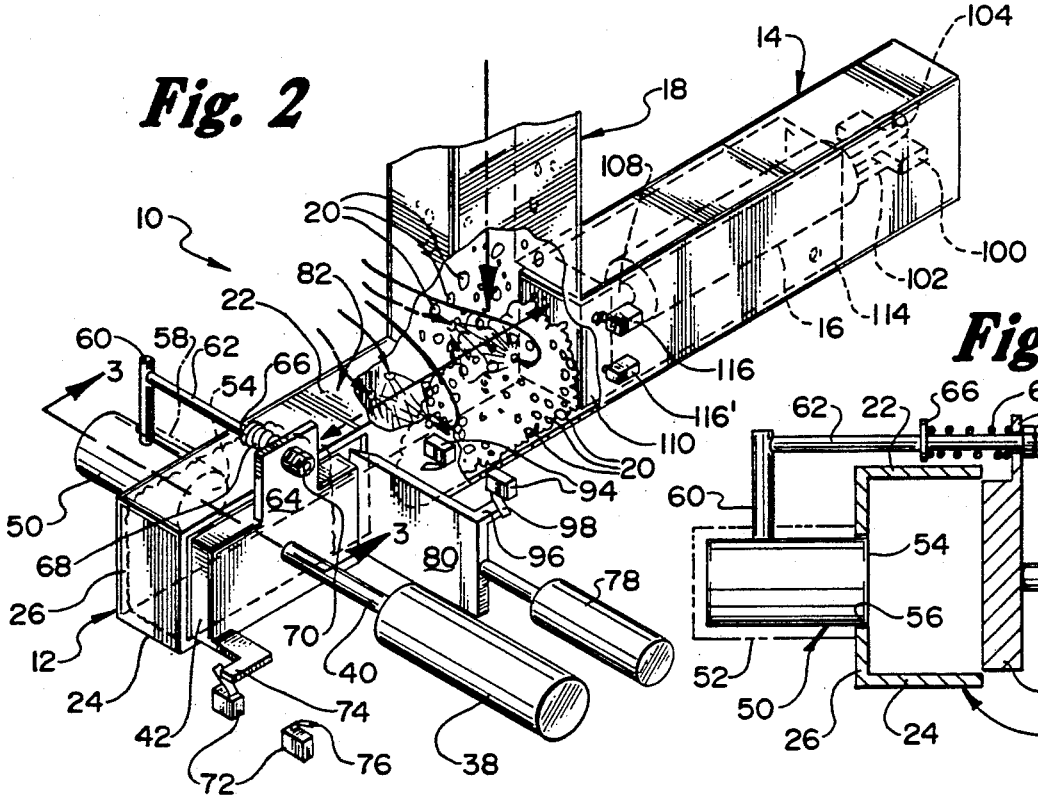
FIG. 2 is a simplified view, similar to that of FIG. 1, showing the ram piston face in its retracted position and with ice particles being admitted, through an input chute, to a location between the retracted ram piston face and the opening to the compression chamber.
Figure 4:
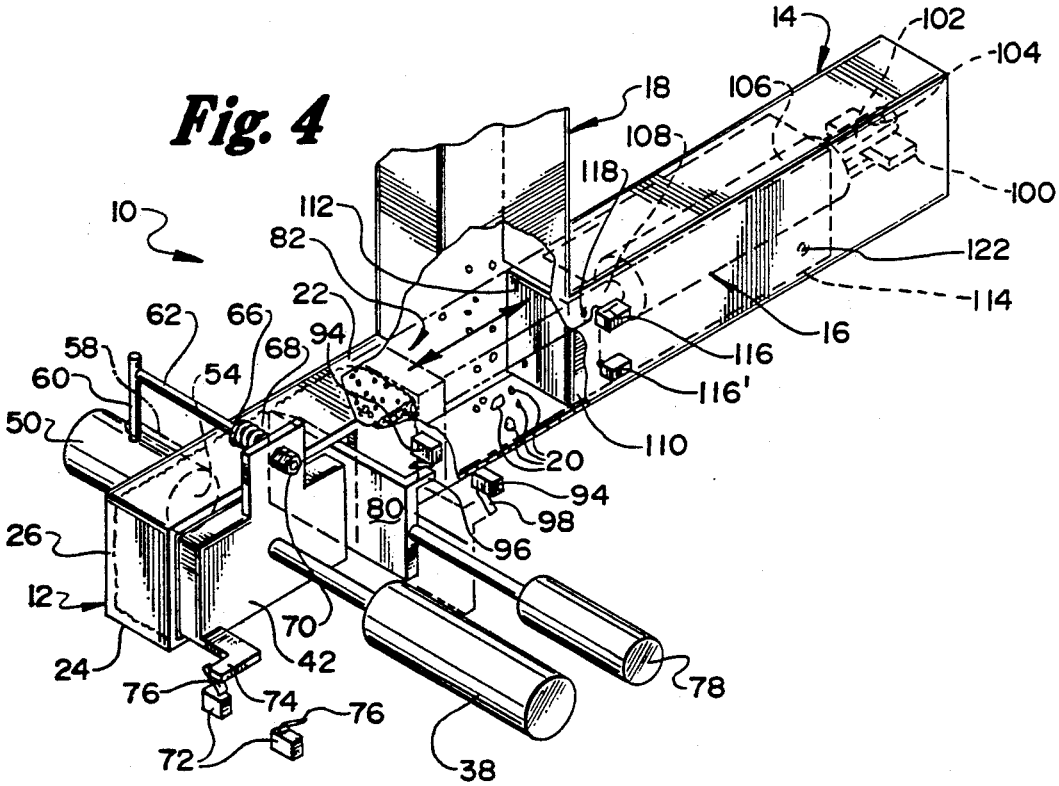
FIG. 4 is a view similar to that of FIG. 2 showing the ram piston face in its extended position having urged ice particles into the compression chamber and compacted those particles therewithin.
Figure 5:
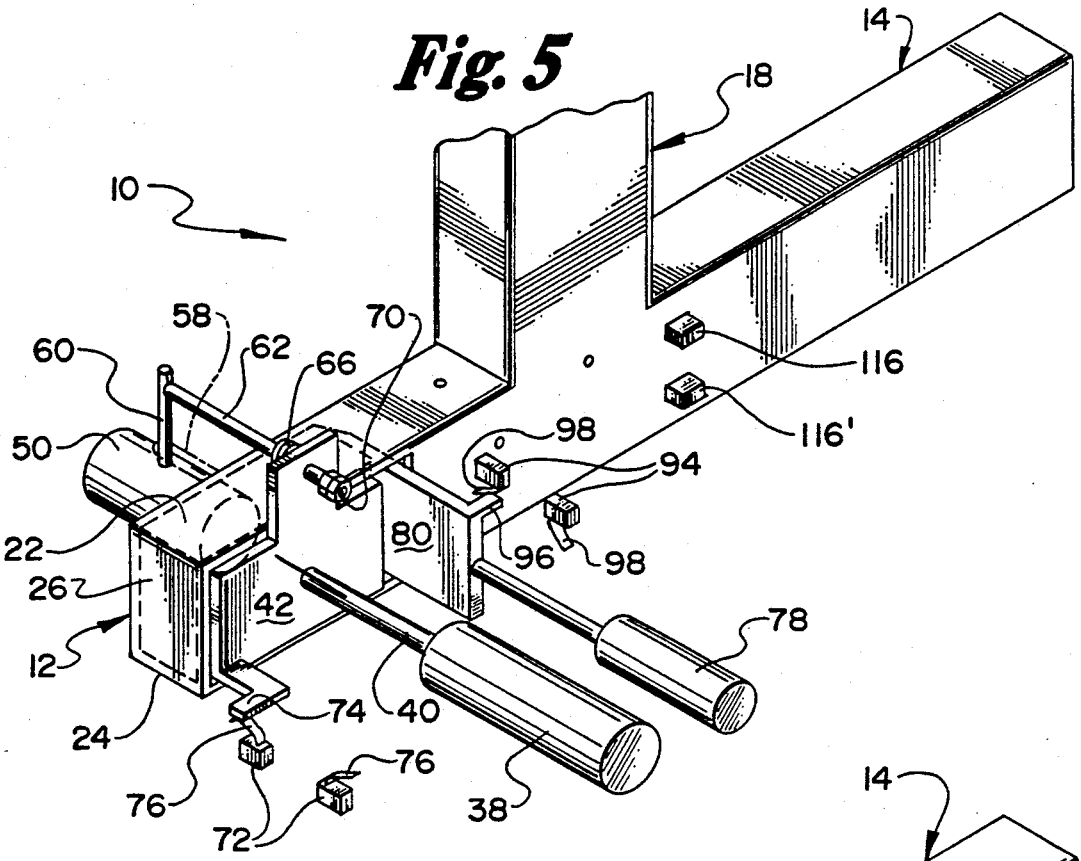
FIG. 5 is a view similar to that of FIG. 3 showing a cutting knife having been extended to cut the accumulated, compacted ice particles and occluding the opening to the compression chamber.
Figure 6:
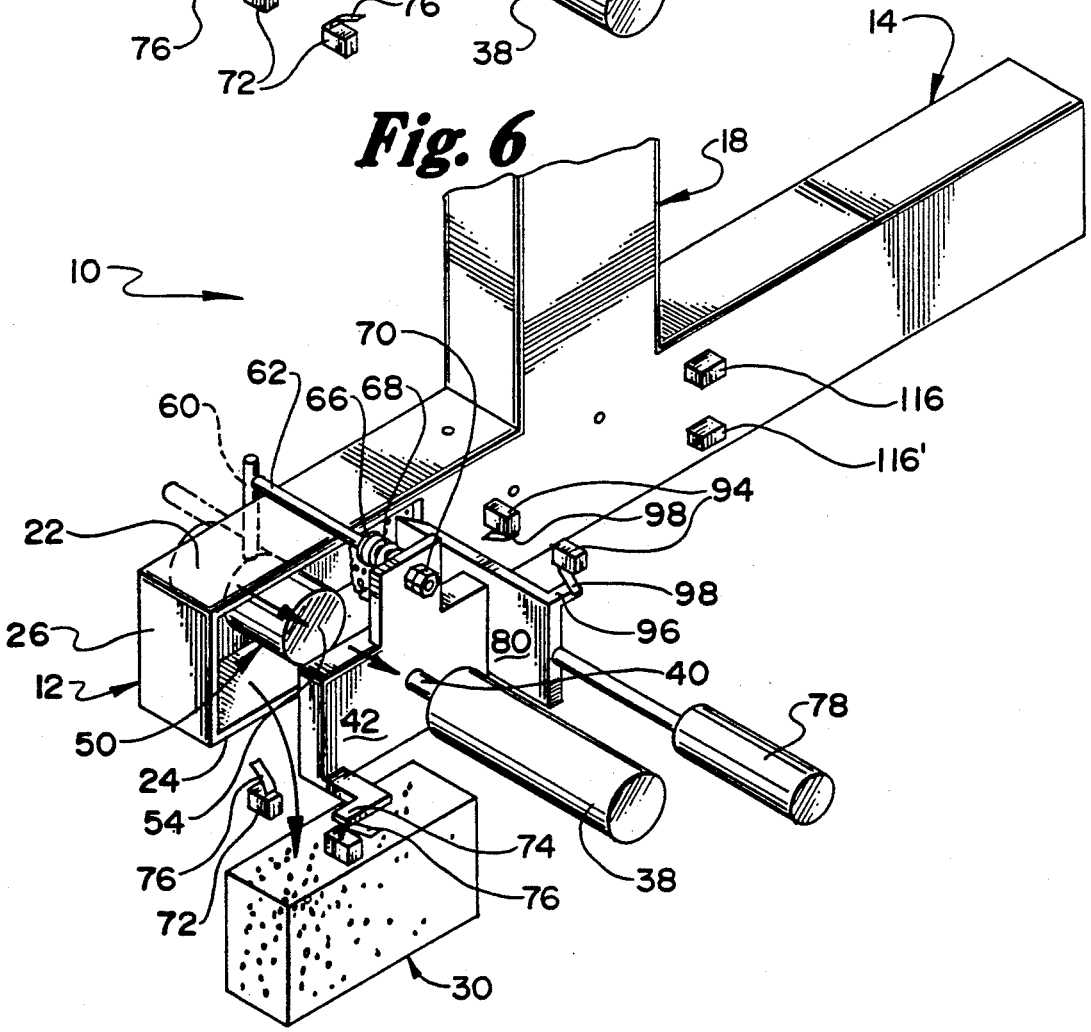
FIG. 6 is a view similar to that of FIG. 5 showing a portion of the wall defining the compression chamber retracted to afford egress to the formed block of ice.

FIGS. 1, 2, 4, 5, and 6 illustrate a pair of limit switches 72 for ascertaining the location of the compression piston 42 relative to the compression chamber 12. The piston carriage 44 carries a tab 74 which is shown as extending from the carriage 44 in a direction in which ice particles are urged into the compression chamber 12. The limit switches 72 are positioned so that paddles 76 of the switches 72 will be engaged by the tab 74 as the carriage 44 moves between positions wherein the compression piston 42 closes the wall 26 of the compression chamber 12 and is retracted to afford egress to a formed block of ice 30. FIGS. 1 and 6 show the limit switch, representative of retraction of the compression piston 42, as being engaged by the tab 74 and actuated thereby. FIGS. 2 and 4 show the limit switch, representative of closure of the compression chamber 12 by the compression piston 42, as being engaged and actuated by the tab 74 carried by the piston carriage 44. FIG. 5 shows a third position of the compression piston 42 wherein it has been moved, against the resistance of the coil spring 68 carried by the tie rod 62, into the compression chamber 12 to effect final compression of the block of ice 30 and removal of excess moisture therefrom. It will be noted that, in this third position, the tab 74 carried by the piston carriage 44 is still engaging and actuating the second limit switch.

The bulkhead 34 also mounts a knife cylinder 78. The location of mounting on the bulkhead 34 is such so that the knife 80, when extended in a manner as will be discussed hereinafter, is able to extend across, and occlude, an opening 82 to the compression chamber 12 through which ice, deposited proximate the opening 82 through the input chute 18, is urged into the compression chamber 12 by the face 112 of the piston 110 mounted to a charging packer ram 16 received within the ram housing 14.

The knife 80 is carried by its own carriage 88, and the knife carriage 88 is disposed for movement, along one or more knife guide bars 90 extending between the bulkhead 34 and the compression chamber 12, between its extended position occluding the opening 82 to the compression chamber 12, and its retracted position not obstructing the opening 82. One or more of the knife guides 92, mounted to the knife carriage 88, ride on corresponding knife guide bars 90.

FIGS. 2 and 6 illustrate the knife 80 in its retracted position. FIGS. 4 and 5 illustrate it in its extended position occluding the opening 82 to the compression chamber 12 through which the ice particles are fed.

Figure 3:
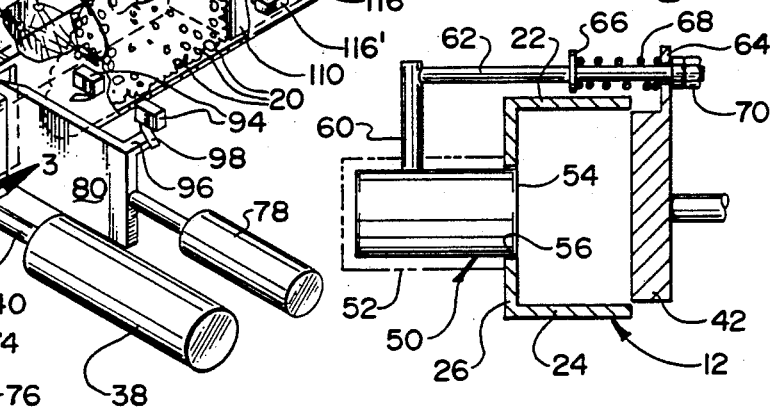
FIG. 3 is a sectional elevational view taken generally along the line 3—3 of FIG. 2.

All of the figures, with the exception of FIG. 3, illustrate a pair of limit switches 94 for ascertaining the position the knife 80 is occupying at any particular point in time. The knife 80 is provided with a tab 96, as is true in the case of the compression piston carriage 44, and the knife tab 96 engages the paddle 98 of one of the limit switches 94, depending upon which position the knife 80 is occupying.

FIGS. 1, 2, and 4 illustrate, either in solid line or phantom line, various components disposed within the ram housing 14. A mounting shelf 100 affixed within the housing 14 at the rear end thereof. The ram 16 is attached to this shelf 100 by a clevis 102. A pin 104 is passed through registered apertures in the legs of the clevis 102 and in the mounting shelf 100.

The ram 16 includes a cylinder 106 having a shaft 108 which is extendable therefrom. The forward end of the shaft 108 carries the packer piston 110 which has a face 112 for engaging the ice particles deposited down the input chute 18.

FIGS. 1, 2, and 4 illustrate a skirt 114 extending over the ram cylinder 106, the skirt 114 being attached to the packer piston 110 and extending rearwardly therefrom. As will be able to be seen in view of this disclosure, when the ram packer piston 110 is actuated to push ice particles, deposited down the input chute 18, through the opening 82 in the compression chamber 12 and into the chamber 12 for compaction, the skirt 114 will preclude ice particles and "snow", which continue to pass down the input chute 18, from being deposited behind the ram packer piston 110. Consequently, the various ram components will be precluded from becoming frozen up.

The packer piston 110 is disposed for movement between a position outside of the input chute 18 and one in which it has crossed the input chute 18 to urge ice particles having passed down the chute 18 through the opening 82 in the compression chamber 12 and into that chamber 12. FIGS. 2 and 4–6 illustrate a pair of limit switches 116 which ascertain the position at which the ram packer piston 110 is located. These limit switches 116 are mounted in the longitudinally-extending wall of the ram housing 14. As seen in FIGS. 2, and 4–6, the limit switches 116 are disposed one above the other. FIGS. 2 and 4 illustrate a first recess 118 in which a roller detent 120 of the upper limit switch 116 is received when the ram packer piston face 112 is in its retracted position. The entry of the detent 120 into the recess 118 effects ascertainment of the piston face 112 in its retracted position.

The skirt 114 is also provided with a second recess 122 proximate its rearward end. While the cooperation of the first recess 118 with its corresponding limit switch detent 120 was able to determine a retracted situation because of the position of the first recess 118 proximate the forward end of the skirt 114, the second recess 122 is disposed proximate the rearward end of the skirt 114. Consequently, while it is able to become registered with a roller detent 124 on the second, or lower limit switch 116', this will not occur until the packer piston 110 and the skirt 114 carried thereby move to their extended positions.

The device 10 would, typically, employ microprocessor means (not shown). Such means would function to receive information from the various sensors relative to positioning of the components, and would transmit signals to initiate operation of the various cylinders to effect desired movement and positioning of those components. For example, state-of-the-art electronics could be utilized in the microprocessor means to effect ascertainment that the ram packer piston 110 is unable to achieve its fully extended position, as represented by roller detent 124 not being able to become registered with second recess 122. Off-the-shelf electronic components could be utilized in a manner known in the art to measure that such a fully extended position of the ram packer piston 110 is not achieved within a defined time after initiation of movement of the piston 110 from its fully retracted position, wherein roller detent 120 is registered with first recess 118. Any appropriate device for accomplishing this function would, however, be acceptable for incorporation for use with the present invention.

FIG. 1 illustrates a plurality of fluid lines 126 communicating with the space between the retracted ram packer piston 110 and the opening 82 to the compression chamber 12. These lines 126 can function to introduce a liquid, such as water, into the space to allow for more complete compaction of the ice particles introduced through the input chute 18. It will be understood, that these lines 126, while not essential, are desirable for the overall operation of the device 10.

The operation of the device 10 will now be described. Normal starting positions for the various components are illustrated in FIG. 2. The compression piston 42 is in its intermediate position closing the side of the compression chamber 12, but not extending into the chamber 12 to squeeze out excess water in the ice. The knife 80 is retracted so as not to occlude the entrance 82 to the compression chamber 12. The ram packer piston 110 is withdrawn so that ice particles and "snow" can be introduced into the space between the ram housing 14 and compression chamber 12 through the input chute 18. These various positions are ascertained, and operation of the mechanism begins.

Raw ice materials are deposited, through the input chute 18, into the space between the ram housing 14 and compression chamber 12. At intervals, the ram cylinder 106 is actuated to urge the packer piston 110 from its retracted position, in a direction toward the compression chamber 12, and to its extended position somewhat short of the opening 82 to the compression chamber 12. Operation of the ram cylinder 106 will continue cyclicly until raw ice material has accumulated in the compression chamber 12 and been compacted therein sufficiently so as to preclude the ram 16 from extending to dispose the packer piston 110 fully at its extended location. The roller detent 124 carried by the lower limit switch 116' will, consequently, be unable to enter the rearward recess 122 in the skirt 114 carried by the ram 16. When this condition is met, additional reciprocation of the ram 16 will be precluded until other steps are completed. It will be observed that during the cycling of the ram 16, raw ice materials being introduced through the input chute 18 will not be able to enter behind the ram packer piston 110 because of the skirt 114.

With the accumulation and compaction of the raw ice material in the compression chamber 12 to an extent so that the packer piston 110 is unable to achieve its extended position, the knife 80 can be actuated, and the knife 80 is at such a location so that the ice block 30 being formed will be able to be cut to a length defined by the axial location of the knife 80. After cutting the ice block 30 to length, the knife 80 will remain in position until the compression piston 42 has been actuated to squeeze excess water out of the block 30.

FIG. 3 illustrates the compression piston 42 in its intermediate position closing the compression chamber wall 26 but without actually entering the chamber 12. One will observe, however, that the size of the piston 42 is sufficiently small so that, upon signal, it can be urged into the compression chamber 12 a distance governed by the spacing between the compression piston carriage strut 64 and the annular shoulder 66 on the tie rod 62. Again, because of the lost motion compression spring 68, the ejector face 54 will not withdraw from a disposition closing the aperture 56 through which it extends into the compression chamber 12.

After the compression piston 42 has been extended into the compression chamber 12 to squeeze out excess moisture, the block forming process is complete. The compression piston 42 will, therefore, be retracted, initially, to its intermediate position closing the side of the compression chamber 12. Thereafter, further retraction of the piston 42 will cause the ejector 50 to be drawn through the aperture 56 in which it is disposed and into the interior of the compression chamber 12. The ejector 50 will, thereby, have the effect of urging the formed block 30 out of the chamber 12. This will, of course, be able to occur, since the continued withdrawal of the compression piston 42 opens the side of the compression chamber 12. This is best illustrated in FIG. 6.

The ice block 30 formed will be allowed to fall from the compression chamber 12 because of the action of the ejector 50. A conveyor (not shown) can be provided to receive the completed ice block 30 and to transfer the block 30 to a storage location.

Numerous characteristics and advantages of the invention have been set forth in the foregoing description. It will be understood, of course, that this disclosure is, in many respects, only illustrative. Changes can be made in details, particularly in matters of shape, size, and arrangement of parts without exceeding the scope of the invention. The invention's scope is defined in the language in which the appended claims are expressed.

What is claimed is:

1. Apparatus for uniformly forming blocks of ice to a desired size, comprising:

(a) a wall defining a compression chamber into which raw ice particles are fed through an opening;

(b) reciprocally disposed ram means for urging ice particles through said opening into said compression chamber, and for compacting the particles within the chamber;

(c) means for sensing the preclusion of movement of said ram means, in a direction in which said ram means moves when urging ice particles through said opening, as a result of accumulation of compacted ice in said compression chamber; and (d) means, responsive to the sensing of a preclusion of movement of said ram means, for cutting the compacted ice to a block of the desired size.

2. Apparatus in accordance with claim 1 wherein said cutting means comprises a reciprocally disposed knife which moves across said opening to cut the compacted ice to the desired size and occlude said opening.

3. Apparatus in accordance with claim 2 wherein said compression chamber includes a first compression chamber wall portion retractable to afford egress to the cut block of ice.

4. Apparatus in accordance with claim 3 wherein said retractable wall portion is movable into said compression chamber to compress the compacted ice block prior to retraction of said retractable wall portion for egress of the block.

5. Apparatus in accordance with claim 4 further comprising means for positively ejecting the ice block formed within said compression chamber when said retractable wall portion is retracted.

6. Apparatus in accordance with claim 5 wherein said positive ejecting means comprises a second compression chamber wall portion opposite said retractable portion, said opposite wall portion being disposed for extension into said compression chamber concurrent with retraction of said retractable portion.

7. Apparatus in accordance with claim 6 further comprising means for slaving said opposite wall portion to said retractable wall portion.

8. Apparatus in accordance with claim 6 further comprising an ejector disposed for movement into said compression chamber, and wherein said opposite wall portion comprises a distal face of said ejector.

9. Apparatus in accordance with claim 1 wherein said ram means is reciprocable between a retracted position and an extended, compacting position, and further comprising means for sensing location of said ram means in its retracted and extended positions.

10. Apparatus in accordance with claim 9 wherein said means for sensing the preclusion of movement of said ram means as a result of accumulation of compacted ice in said compressor chamber comprises said means for sensing location of said ram means in its extended position, wherein said location sensing means is unable to sense positioning of said ram means in its extended position as a result of accumulation of compacted ice precluding said ram means from achieving its extended position.

11. A press for forming ice blocks to a uniform, desired size, comprising:

(a) a compression chamber into which raw ice particles are fed, said compression chamber being defined by an upper wall, a lower wall, and a side wall having an opening formed therethrough, said opening serving to afford passage of ice particles being fed into said compression chamber;

(b) a ram mounting a piston having a face disposed for reciprocal movement between a retracted position and a forward position, said piston face serving to urge ice particles through said opening into said compression chamber, and to compact the ice particles;

(c) input feed means intermediate said opening and said ram piston face, when said piston face is in said retracted position thereof, for positioning ice particles at a location for urging into said compression chamber by said ram piston face;

(d) means for sensing location of said ram piston face at its retracted and extended positions, wherein, when the volume of ice particles fed into, and compacted within, said compression chamber, is sufficiently great so as to exceed the desired size of an ice block to be formed, said ram piston face cannot achieve said extended position thereof; ? ,/ (e) means for ascertaining that said ram piston face is precluded from achieving its extended position; and (f) knife means, responsive to the sensing of a preclusion of said ram piston face from achieving its extended position, for cutting the compacted ice to a block of the desired size.

12. A press in accordance with claim 11 wherein said ram is mounted within a housing defined by a longitudinally-extending wall, said press further comprising a skirt overlying said ram and disposed for reciprocal movement therewith within said housing to preclude deposit of ice particles behind said ram piston face when said ram piston face is in said extended position thereof.

13. A press in accordance with claim 12 wherein said skirt has a first recess formed therein at a forward end thereof proximate said ram piston face, and a second recess formed therein at a rearward end thereof, and wherein said means for sensing location of said ram piston face comprises a pair of limit switches mounted to said longitudinally-extending housing wall, each having a detent receivable in one of said recesses formed in said skirt when said ram piston face is at one of said extended and retracted positions thereof.

14. A press in accordance with claim 11 further comprising means for disposing said knife means for reciprocation across said opening to cut the compacted ice to the desired size and occlude said opening.

15. A press in accordance with claim 11 wherein said compression chamber includes means to afford egress to the cut block of ice.

16. A press in accordance with claim 11 further comprising means for positively ejecting the ice block formed within said compression chamber after the ice block is formed.

* * * * *